US006119309A

United States Patent [19]

Lu

[11] Patent Number: 6,119,309

[45] Date of Patent: Sep. 19, 2000

[54] HANDLE STRUCTURE OF A SUITCASE

[75] Inventor: Lien-Ching Lu, Miao Li Hsien, Taiwan

[73] Assignee: Ting Cheng Co., Ltd., Miao Li Hsien, Taiwan

[21] Appl. No.: 09/245,349

[22] Filed: Feb. 5, 1999

[51] Int. Cl.[7] ..... A45C 13/26

[52] U.S. Cl. ..... 16/114.1; 16/110.1; 16/411; 16/430

[58] Field of Search ..... 16/110.1, 114.1, 16/407, 408, 411, 430; 294/25, 137, 171

[56] References Cited

U.S. PATENT DOCUMENTS

| | | | |
|---|---|---|---|
| 3,500,973 | 3/1970 | Bush | 16/114.1 |
| 3,692,155 | 9/1972 | Laurita | 16/114.1 |
| 4,087,141 | 5/1978 | Roberts | 16/111 R |
| 5,475,896 | 12/1995 | Wang | 16/111 R |
| 5,640,741 | 6/1997 | Yano | 16/430 |

*Primary Examiner*—Anthony Knight
*Assistant Examiner*—E Peavey
*Attorney, Agent, or Firm*—Rosenberg, Klein & Lee

[57] ABSTRACT

A handle structure of a suitcase includes an inverted U-shaped body and an attachment attached to the inside of the body. The body has a ridge extending from the inside thereof and a plurality of protrusions extending from the top and the bottom of the ridge. Two engaging members extend from the inside of the body and are located on two ends of the ridge. The attachment has a groove defined in the inside thereof and a plurality of recesses defined in the inner top and the inner bottom of the groove so that the ridge is received in the groove with the protrusions engaged with the recesses. The two engaging members are engaged with two apertures defined in the inside of the attachment.

4 Claims, 5 Drawing Sheets

HANDLE STRUCTURE OF A SUITCASE

FIELD OF THE INVENTION

The present invention relates to a handle structure of a suitcase, and more particularly, to an improved handle which is combined by a body having protrusions and an attachment having recesses, wherein the protrusions are received in the recesses.

BACKGROUND OF THE INVENTION

A conventional handle of a suitcase is shaped as an inverse U and has a protrusion portion attached to the inside of the handle so that when the user's hand holds the handle, the protrusion portion is fitted in the space enclosed by the fingers. The handle is generally manufactured by way of plastic injection. However, due to the characters of the plastic material, the shape of the handle could be deformed because the temperature of the mold for the handle is so high that recessed area will be found on the outside of the handle. If the temperature of the mold is below the desired temperature, the protrusion portion could become a hollow member. In addition, surplus material will be formed on the outside of the boundary between the protrusion portion and the body of the handle because a gap is defined between two parts of the mold at the position between the protrusion portion and the body of the handle. The manufacturers have to remove the surplus material by hands and this takes time and skill.

The present invention intends to provide a handle structure which is composed of a body having protrusions and an attachment having recesses so that the protrusions are engaged with the recesses to firmly engage the attachment to the body of the handle. The structure of the handle simplifies the manufacturing processes and reduces the quantity of unsuccessful products. By the handle structure of the present invention, the shortcoming of the conventional handle are overcome.

SUMMARY OF THE INVENTION

In accordance with one aspect of the present invention, there is provided a handle structure for a suitcase and comprising a body having a ridge extending from the inside thereof with protrusions extending from the top and the bottom of the ridge. Two engaging members extend from the inside of the body. An attachment has a groove defined in the inside thereof so as to receive the ridge therein. The inner top and the inner bottom of the groove each have a plurality of recesses defined therein so that the protrusions are engaged with the recesses. Two apertures are defined in the inside of the attachment so as to receive the two apertures.

The object of the present invention is to provide a simple structure for engaging the attachment with the body of the handle.

Further objects, advantages, and features of the present invention will become apparent from the following detailed description with appropriate reference to the accompanying drawings.

DETAILED DESCRIPTION OF THE PREFERRED EMBODIMENTS

Figure 1:
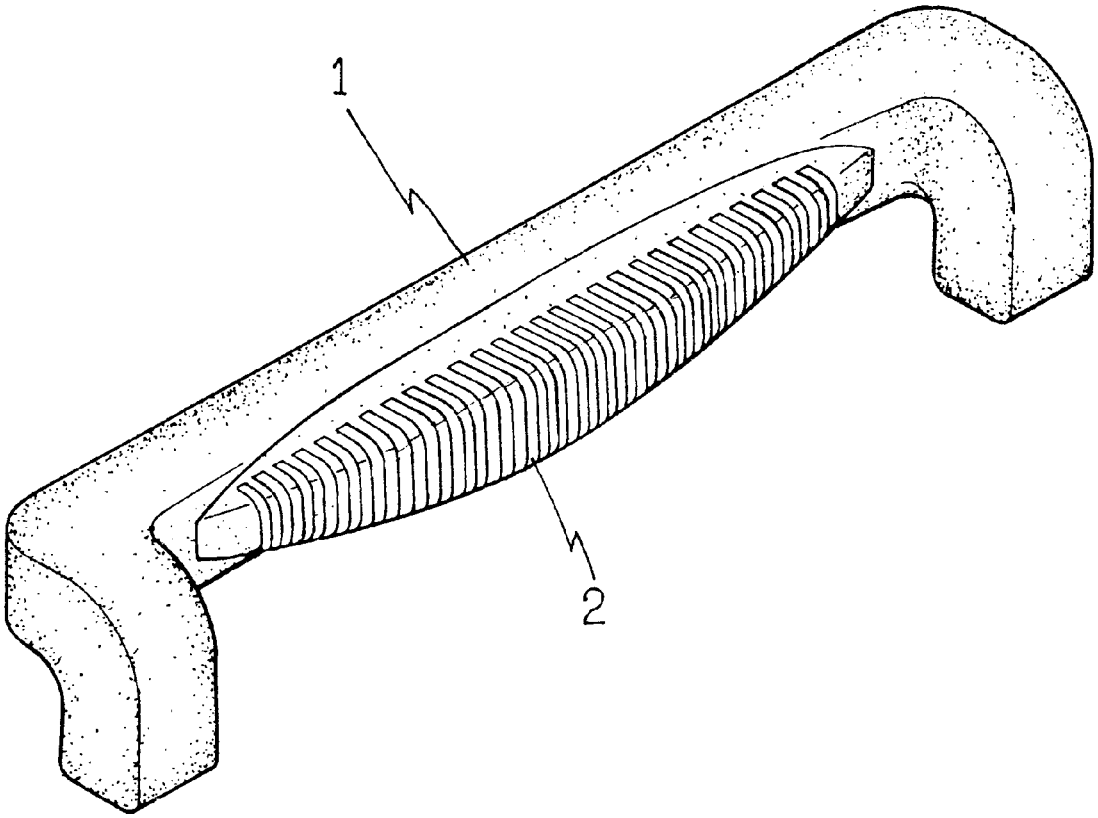
FIG. 1 is a perspective view of the handle in accordance with the present invention.
Figure 2:
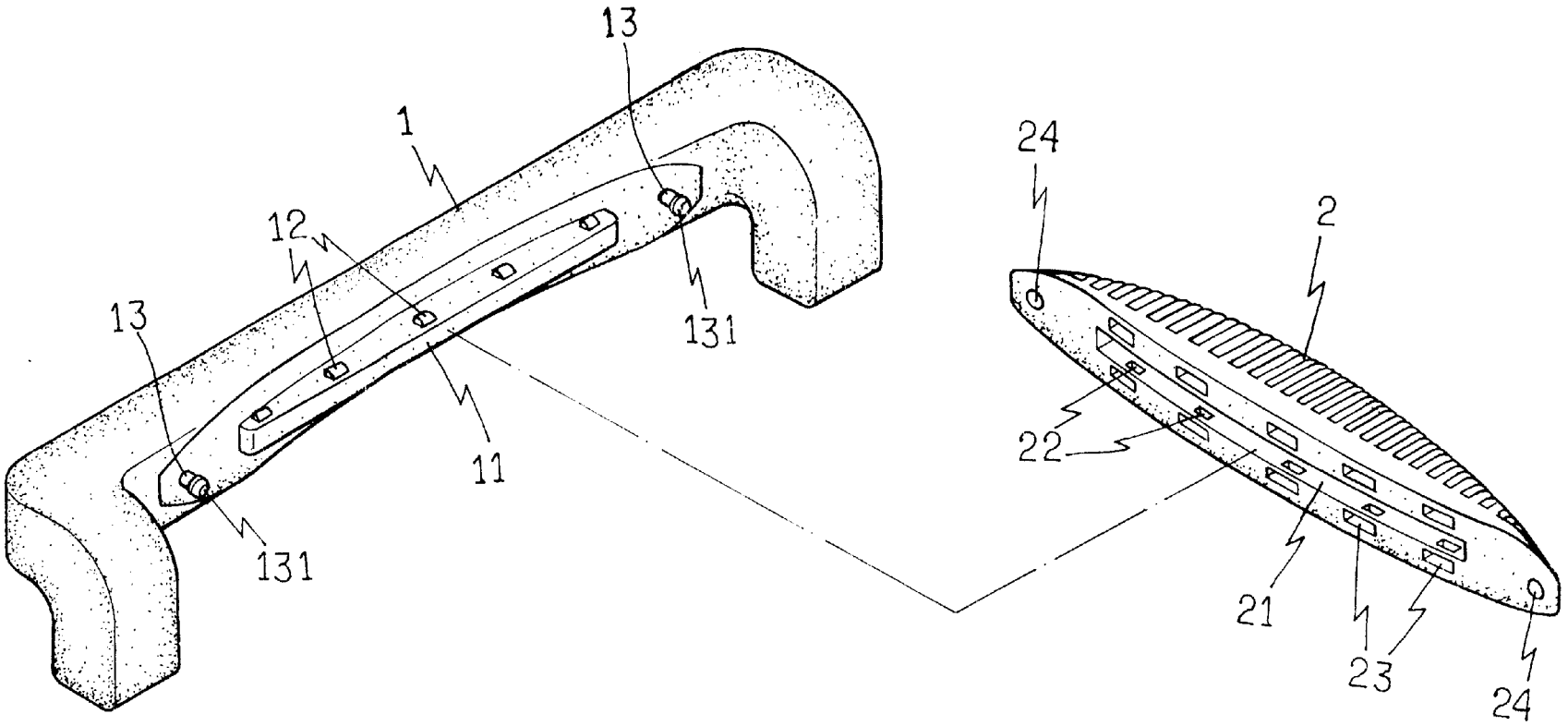
FIG. 2 is an exploded view of the body and the attachment of the handle in accordance with the present invention.
Figure 3:
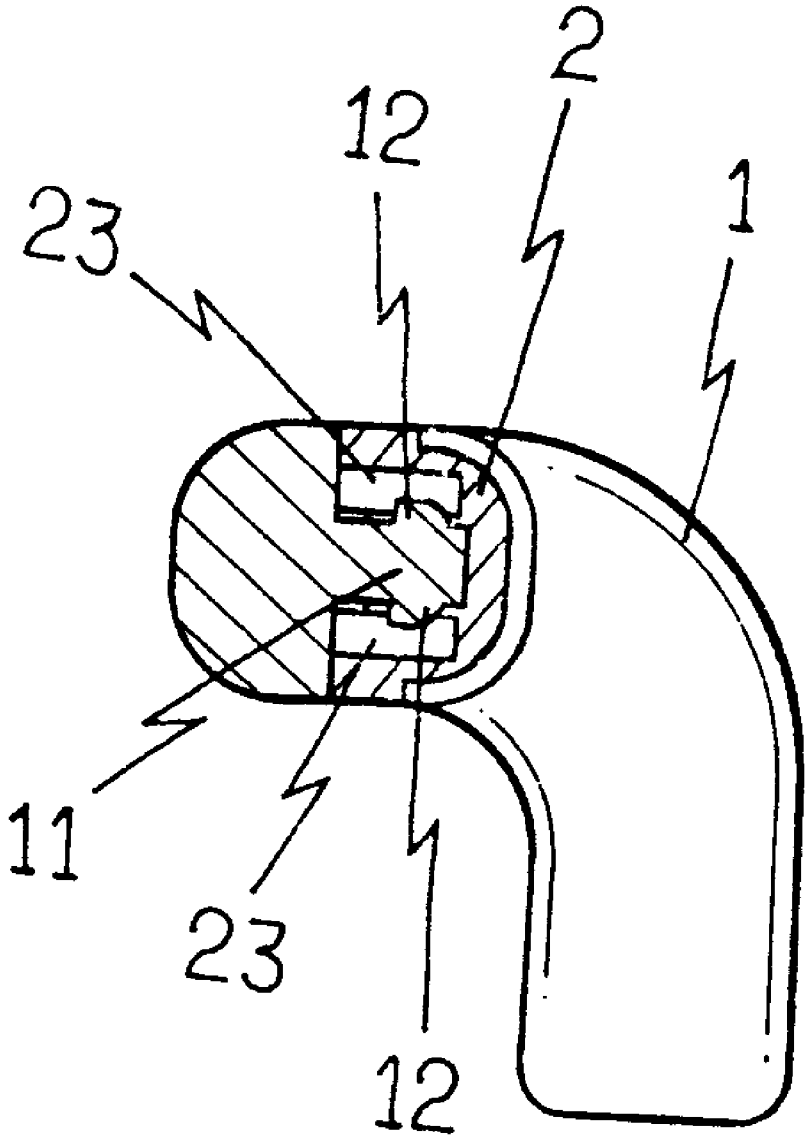
FIG. 3 is a side elevational view, partly in section, of the engagement of the attachment and the body in accordance with the present invention.

Referring to FIGS. 1 to 3, the handle structure for a suitcase in accordance with the present invention comprises a body 1 being an inverted U-shaped member and an attachment 2 which is attached to the inside of the body 1. The body 1 has a ridge 11 extending from the inside thereof and a plurality of protrusions 12 extending from the top and the bottom of the ridge 11. Two engaging members 13 extend from the inside of the body 1 with the ridge 11 located between the two engaging members 13. Each of the engaging members 13 has an enlarged head 131.

The attachment 2 has a groove 21 defined in the inside thereof, the groove 21 defined by an inner top and an inner bottom. Each of the inner top and the inner bottom of the groove 21 has a plurality of recesses 22 defined therein. Two rows of passages 23 are defined in the inside of the attachment 2 with the groove 21 located between the two rows of the passages 23. The two rows of the passages 23 respectively communicate with the recesses 22 in the inner top and the inner bottom of the groove 21 so that when attaching the attachment 2 to the body 1, the ridge 11 is received in the groove 21 and the protrusions 12 are engaged with the recesses 22.

Two apertures 24 are defined in the inside of the attachment 2 and located on the two ends of the groove 21 so that the two engaging members 13 are engaged with the two apertures 24 to further secure the engagement of the attachment 2 and the body 1.

Figure 4:
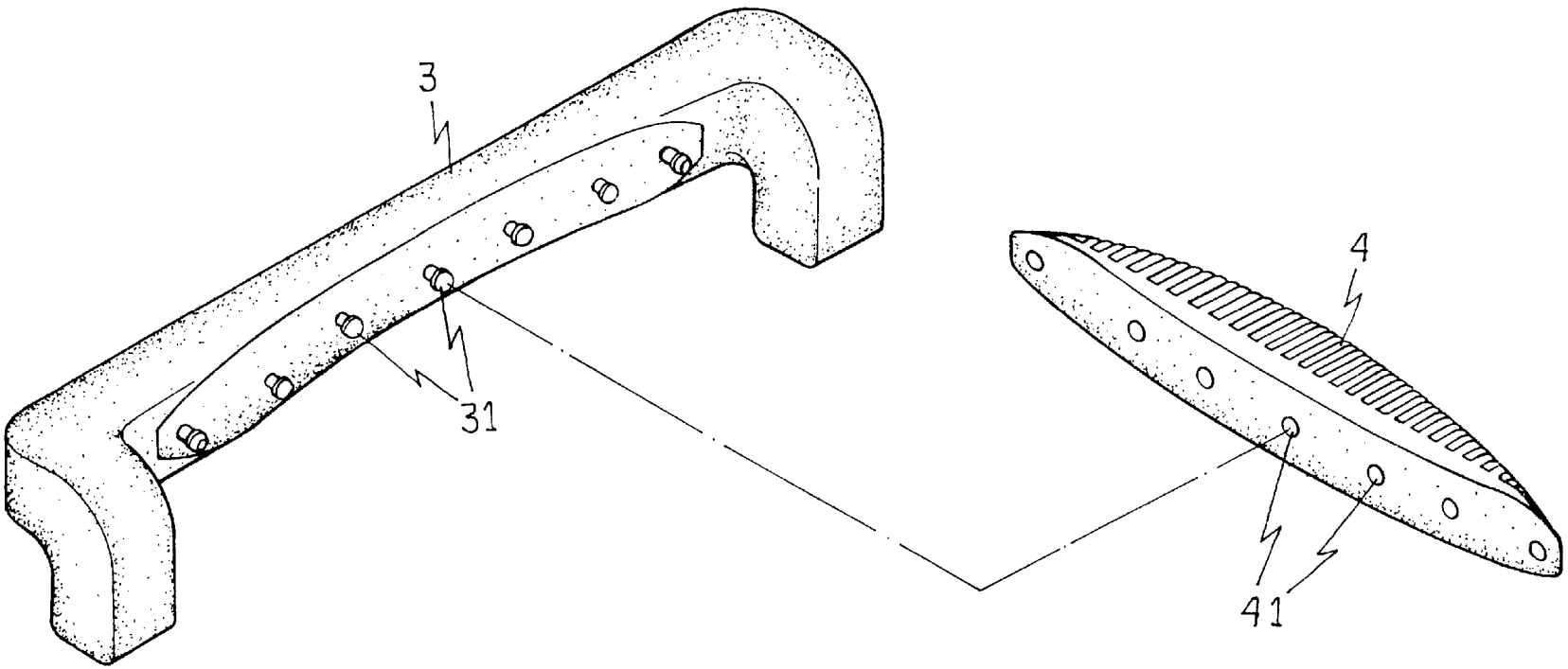
FIG. 4 is an exploded view of another embodiment of the body and the attachment of the handle in accordance with the present invention.
Figure 5:
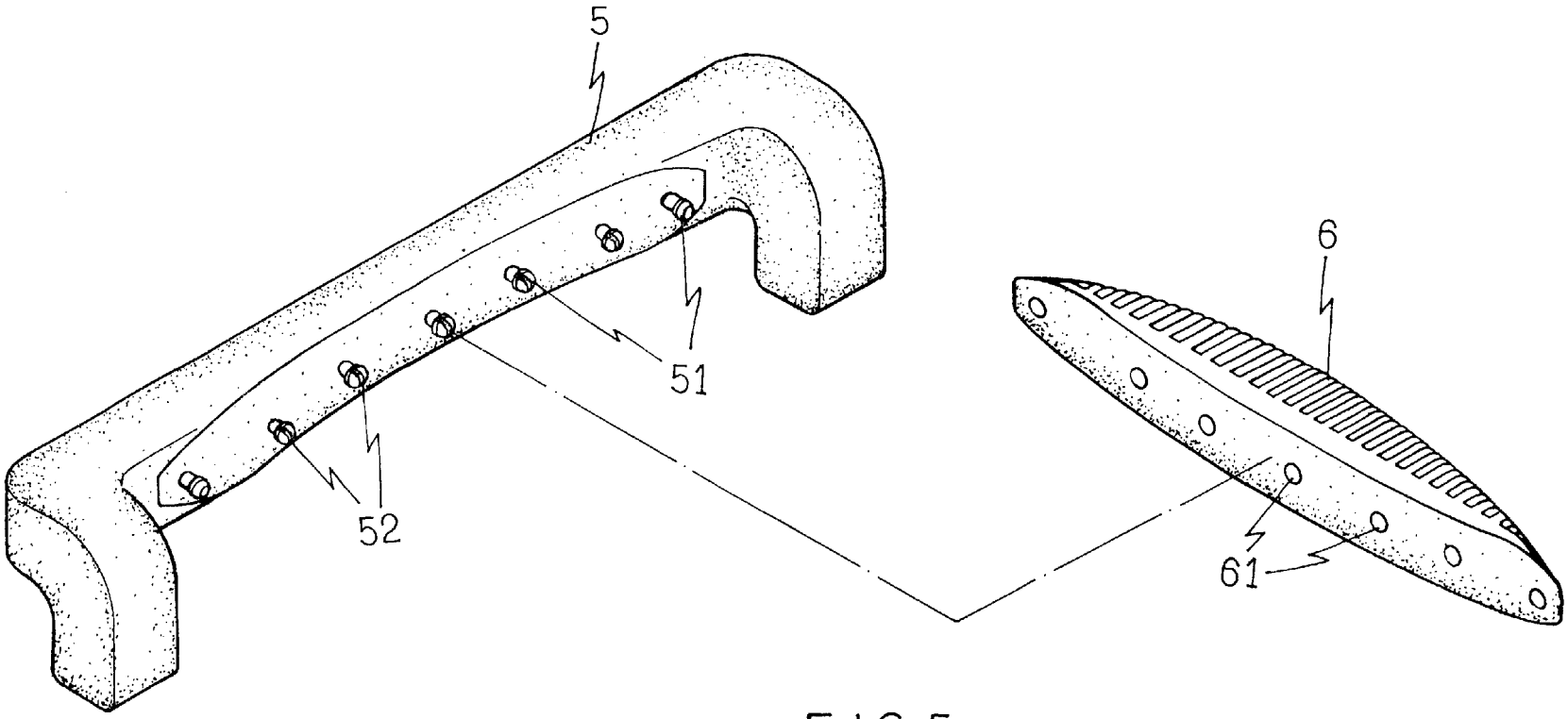
FIG. 5 is an exploded view of yet another embodiment of the body and the attachment of the handle in accordance with the present invention.

FIG. 4 shows an embodiment of the handle wherein the body 3 has a plurality of engaging members 31 extending from the inside thereof and the attachment 4 has a plurality of holes 41 defined in the inside thereof so that the attachment 4 is firmly connected to the body 3 by engaging the engaging members 31 with the holes 41. FIG. 5 show yet another embodiment of the handle wherein the body 5 has a plurality of engaging members 51 extending from the inside thereof and the attachment 6 has a plurality of holes 61 defined in the inside thereof so that the attachment 6 is firmly connected to the body 5 by engaging the engaging members 51 with the holes 61. Each of the engaging members 51 has an enlarged head which has a slit 52 defined therein so as to define two parts on each of the enlarged heads and which have suitable flexibility. When engaging the engaging members 51 with the holes 61, simply inserting the two flexible parts of the enlarged head into the corresponding hole 61. This saves the assembling time.

The invention is not limited to the above embodiment but various modification thereof may be made. It will be understood by those skilled in the art that various changes in form and detail may made without departing from the scope and spirit of the present invention.

What is claimed is:

1. A handle structure for a suitcase, comprising:

a body having a ridge extending from the inside thereof and a plurality of protrusions extending from the top and the bottom of said ridge, two engaging members extending from the inside of said body 1 with said ridge located between said two engaging members, and an attachment having a groove defined in the inside thereof, said groove defined by an inner top and an inner bottom, each of said inner top and said inner bottom of said groove having a plurality of recesses defined therein so that said ridge is received in said groove with said protrusions engaged with said recesses, two apertures defined in said inside of said attachment with said groove located therebetween for said two engaging members engaged with said two apertures.

2. The handle structure as claimed in claim 1 further comprising two rows of passages defined in the inside of said attachment with said groove located between said two rows of said passages, said two rows of said passages respectively communicating with said recesses in the inner top and the inner bottom of said groove.

3. The handle structure as claimed in claim 1, wherein each of said engaging members has an enlarged head.

4. The handle structure as claimed in claim 3, wherein each of said enlarged heads has a slit defined therein.

* * * * *